US007045190B2

(12) United States Patent
Inagaki et al.

(10) Patent No.: US 7,045,190 B2
(45) Date of Patent: May 16, 2006

(54) PACKAGING MATERIAL AND PACKAGED PRODUCT

(75) Inventors: Hiromichi Inagaki, 1-143, Aza-Maedamen, Inuyama-shi, Aichi 484-0049 (JP); Sakaru Takahashi, Tokyo (JP)

(73) Assignees: Hiromichi Inagaki, Inuyama (JP); Plast Corporation, Tokyo (JP)

( * ) Notice: Subject to any disclaimer, the term of this patent is extended or adjusted under 35 U.S.C. 154(b) by 324 days.

(21) Appl. No.: 10/009,205

(22) PCT Filed: Apr. 25, 2001

(86) PCT No.: PCT/JP01/03563

§ 371 (c)(1),
(2), (4) Date: Dec. 4, 2001

(87) PCT Pub. No.: WO01/81201

PCT Pub. Date: Nov. 1, 2001

(65) Prior Publication Data

US 2003/0031763 A1 Feb. 13, 2003

(30) Foreign Application Priority Data

Apr. 26, 2000 (JP) ..... 2000-125673
Dec. 11, 2000 (JP) ..... 2000-376229

(51) Int. Cl.
*B65D 81/34* (2006.01)
*B65D 30/26* (2006.01)
*B32B 3/24* (2006.01)

(52) U.S. Cl. ..... 428/136; 428/131; 428/138; 428/137; 383/211; 383/45; 383/94; 383/51; 426/113; 426/118; 426/107; 220/203.16; 220/203.11; 220/203.08; 220/203.01; 220/202; 220/203.17

(58) Field of Classification Search ..... 428/136, 428/138, 137, 131; 383/211, 45, 94, 51; 426/113, 118, 107; 220/203.17, 203.16, 220/203.11, 203.8, 203.1, 202, 203.01
See application file for complete search history.

(56) References Cited

U.S. PATENT DOCUMENTS 3,432,087 A * 3/1969 Costello ..... 383/103

(Continued)

FOREIGN PATENT DOCUMENTS

JP 61-69576 4/1986

(Continued)

*Primary Examiner*—William P. Watkins, III
(74) *Attorney, Agent, or Firm*—Flynn, Thiel, Boutell & Tanis, P.C.

(57) ABSTRACT

A packaging material is provided that can provide a packaging bag or container cover in which the contents is shielded from the atmosphere and tightly sealed, a small hole is formed in the appropriate locations, without special processing of the heat seal portion, and the internal pressure is maintained with high stability at a level above the normal pressure. The packaging material is suitable, for example, for heating in a microwave oven. The packaging material uses a film in which a heat sealing agent (4) with a low melting point is applied to a prescribed zone of an oriented film (2) made of a synthetic resin, a cutting line (5) is cut in the oriented film (2) made of a synthetic resin in the form of a solid or broken line passing through the zone coated with the heat sealing agent (4), and a cast film (3) made of a synthetic resin and having heat sealing properties is affixed to the oriented film (2) made of a synthetic resin. Such film is used for a packaging bag (1) or a container cover.

4 Claims, 22 Drawing Sheets

U.S. PATENT DOCUMENTS

| | | | | |
|---|---|---|---|---|
| 4,206,870 | A * | 6/1980 | DeVries | 383/103 |
| 4,640,838 | A | 2/1987 | Isakson et al. | |
| 5,326,176 | A * | 7/1994 | Domke | 383/103 |
| 5,464,969 | A * | 11/1995 | Miller | 219/735 |
| 5,780,824 | A * | 7/1998 | Matos | 219/727 |
| 5,928,553 | A * | 7/1999 | Toshima et al. | 219/725 |
| 5,989,608 | A * | 11/1999 | Mizuno | 426/113 |
| 6,068,898 | A * | 5/2000 | Oyama | 428/35.2 |
| 6,076,969 | A * | 6/2000 | Jaisle et al. | 383/211 |
| 6,106,153 | A * | 8/2000 | Toshima | 383/204 |

FOREIGN PATENT DOCUMENTS

| | | |
|---|---|---|
| JP | 2-108861 | 8/1990 |
| JP | 9-267870 | 10/1997 |
| JP | 9-272180 | 10/1997 |
| JP | 11-292152 | 10/1999 |

* cited by examiner

FIG. 10 (AMENDED)
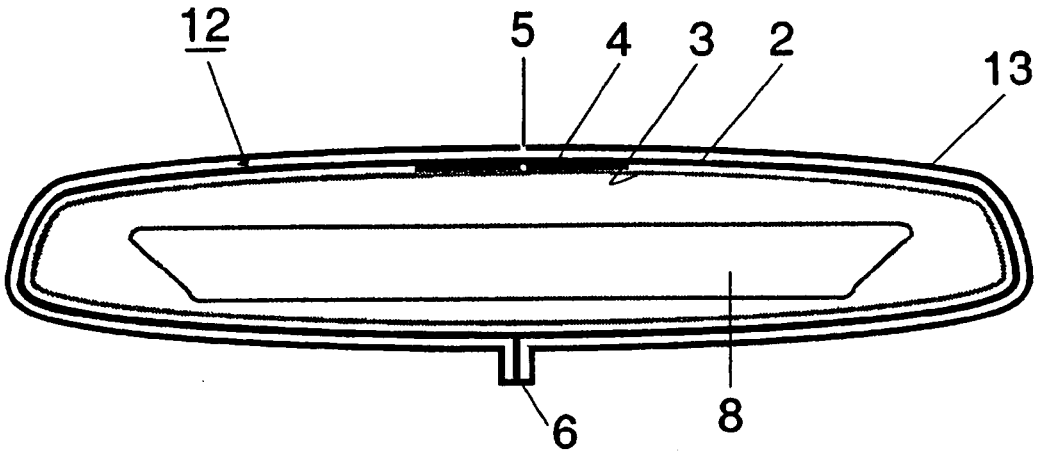

FIG. 16 (AMENDED)
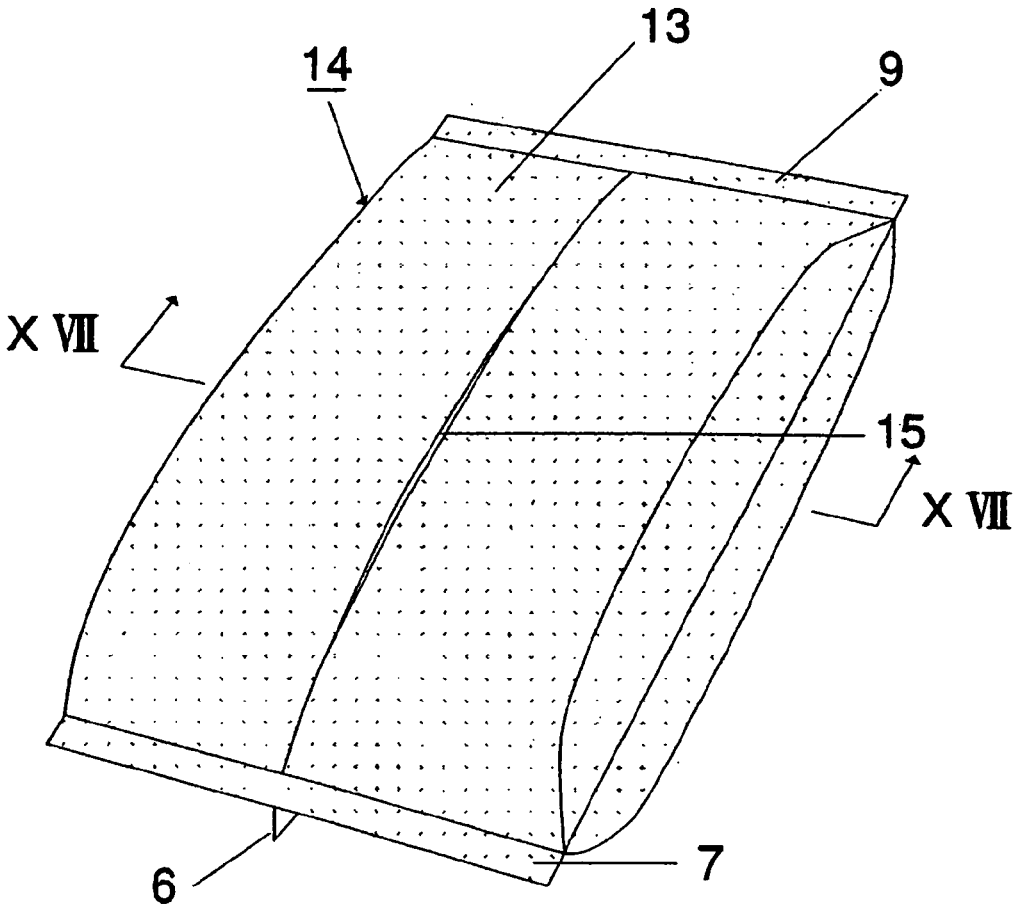

PACKAGING MATERIAL AND PACKAGED PRODUCT

TECHNICAL FIELD

The present invention relates to a packaging material suitable as a substrate for packaging bags or packaging containers employed for heat treatment, for example, in a microwave oven, of processed food or various foods or for thermal sterilization of medical instruments.

BACKGROUND ART

In packaging bags made of synthetic resin films that have been used for sealing its contents, such as food products requiring heat treatment, the following measures have been taken to remove the contents after the heat treatment of the packaging bag having the contents inserted therein.

1. A sealing agent having a low melting point is provided in advance in a zone where the packaging bag is to be opened and other zones are sealed with a constant strength. If the internal pressure is increased when the packaging bag is heated, the zone provided with the sealing agent having a low melting point is opened.

2. A portion of the packaging bag is not sealed. If the internal pressure is increased when the packaging bag is heated, vapors present inside the packaging bag escape to the outside thereof through the zone which is not sealed.

3. Vapor holes are provided in the packaging bag and a tape coated with a sealing agent having a low melting point is affixed onto the vapor holes. If the internal pressure is increased when the packaging bag is heated, the sealing agent having a low melting point is melted, the tape peels off, and the vapors present inside the packaging bag escape to the outside thereof through the vapor holes.

4. Vapor holes are provided in the packaging bag and the vapor holes are closed with a nonwoven fabric. If the internal pressure is increased when the packaging bag is heated, the vapors present inside the packaging bag escape to the outside thereof through the nonwoven fabric.

5. A zone where the packaging bag is to be opened is sealed at a low temperature and other zones are sealed at a high temperature. If the internal pressure is increased when the packaging bag is heated, the vapors present inside the packaging bag peel off the seal in the zone of the packaging bag sealed at a low temperature and escape to the outside thereof.

6. A rift is made in advance at the perimeter of a packaging bag. Immediately prior to heat treatment, the rift is broken and the vapors present inside the packaging bag escape to the outside thereof through the crack.

7. A packaging bag is produced from a two-layer film in which a surface film is laminated with a back film provided with a plurality of small openings. If the internal pressure is increased when the packaging bag is heated, the vapors present inside the packaging bag penetrate in the space between the surface film and back film through the small openings in the back film, peel the surface film from the back film, and escape to the outside.

8. A portion of a sealing zone located on the periphery of the packaging bag is provided as a narrow weak sealing zone. If the internal pressure is increased when the packaging bag is heated, the vapors present inside the packaging bag open the narrow weak sealing zone and escape to the outside.

DISCLOSURE OF THE INVENTION

The following problems were associated with the above-described conventional packaging bags. Since a portion of the sealing zone is open, when liquid is present in the bag, it readily flows out of the bag. When holes are provided in advance in the sealing zone, the inside of the bag is linked to the atmosphere and bacteria easily penetrate therein. When a portion of the sealing zone is made so as to be easily opened because of the difference in melting point, sealing temperature, or sealing width, the opening process is easily destabilized depending on the temperature increase pattern, the opening zone is increased and the pressure inside the bag is difficult to maintain. Automatic bag manufacture and packaging employing a rolled film is difficult to conduct if the sealing zone requires processing.

Another problem associated with the above-described conventional packaging bags was that when the packaging bags were heated in a microwave oven, water contained in the bag contents, such as food products, turned to steam, the steam filled the bag, while increasing the internal pressure, the temperature of the film surface rose accordingly, and the packaging bag that was just removed from the microwave oven was very difficult to open by bare hand.

It is an object of the present invention to resolve the above-described problems and to provide a packaging material suitable for packaging bags in which a small hole is formed in the film and undergoes cyclic expansion and contraction depending on the amount of generated steam, thereby maintaining the internal pressure at a level of no less than the normal pressure. Another object of the present invention is to provide a packaging material using a thermally insulating flexible sheet for the surface, thereby making it possible to hold by bare hands the product immediately after the contents thereof were heated to a high temperature.

The present invention relates to a packaging material using a film laminate in which a heat sealing agent with a low melting point is applied to a prescribed zone of an oriented film made of a synthetic resin, a cutting line is cut in the oriented film made of a synthetic resin in the form of a solid or broken line passing through the zone coated with the heat sealing agent, and a cast film made of a synthetic resin and having heat sealing properties is affixed to the oriented film made of a synthetic resin. The packaging material in accordance with the present invention will be described hereinbelow with reference to a case in which it is used for a packaging bag. The bag body is formed by placing the cast film made of a synthetic resin on the inner side and a product is obtained by inserting food and the like into the bag body. When such a packaging bag is heated in a microwave oven, water contained in the bag contents, such as food, turns to steam, the inside of the bag is filled with this steam and the internal pressure is raised. The film temperature is raised accordingly, the sealing agent with a low melting point is melted and liquefied, and the laminate strength between the oriented film substrate and the cast film serving as a sealant is greatly reduced in the zone where the sealing agent with a low melting point was coated. The sealant in the zone where the sealing agent with a low melting point was coated below the cutting line of the oriented film is freely extended and expanded in the direction of stress acting perpendicular to the cutting line as the internal pressure is increased. However, in the zone that was not coated with the sealing agent with a low melting point, the laminate strength between the oriented film substrate and the sealant is high, free extension and expansion are impossible, the sealant is partially cut and a small hole is formed at the boundary. Since the sealant is constituted of the cast film and has a rubbery elasticity, the small hole undergoes repeated expansion and shrinkage depending on the amount of generated steam and the internal pressure can be adjusted, while the contents are appropriately heated.

The present invention according to claim 2 relates to a packaging material using a film laminate in which a release agent is applied to a prescribed zone of an oriented film made of a synthetic resin, a cutting line is cut in the oriented film made of a synthetic resin in the form of a solid or broken line passing through the zone coated with the release agent, and a cast film made of a synthetic resin and having heat sealing properties is affixed to the oriented film made of a synthetic resin. When a packaging bag fabricated from such materials in the same manner as from the packaging material above is heated in a microwave oven, water contained in the contents thereof, such as food, turns to steam, the inside of the bag is filled with this steam, and the internal pressure is increased. The film temperature is raised accordingly and the sealant is softened. The sealant in the zone where the release agent was coated under the cutting line of the oriented film is freely extended and expanded in the direction of stress acting perpendicular to the cutting line as the internal pressure is increased. However, in the zone that was not coated with the release agent, the laminate strength between the oriented film substrate and the sealant is high, free extension and expansion are impossible, the laminate is partially cut and a small hole is formed at the boundary. Since the sealant is made of a cast film and has a rubber elasticity, the small hole undergoes repeated expansion and shrinkage depending on the amount of generated steam and the internal pressure can be adjusted.

The oriented film may be a uniaxially oriented film or biaxially oriented film. The uniaxially oriented film is difficult to extend in the longitudinal or lateral direction thereof. The biaxially oriented film is difficult to extend in both the longitudinal direction and lateral direction thereof and is used for the substrate because of its excellent mechanical suitability for printing and lamination.

The cast film is easily extended in both the longitudinal and the lateral direction thereof and has a very high resistance to impacts. Since cast films of polyethylene or polypropylene have very stable heat sealing properties and heat seal strength, they are widely used as sealants for packaging laminated materials.

oriented films for general applications are manufactured from polyethylene terephthalate resin (PET), polypropylene resin (PP), and polyamide resin (PA). Cast films for sealants are typically manufactured from the above-mentioned polyethylene (PE) or polypropylene (PP).

In accordance with the present invention, stresses caused by the heating-induced internal pressure are concentrated in the vicinity of the joint of the oriented film and the cast film by using the difference in properties therebetween, a small hole is formed herein, and the internal pressure is maintained at a level of no less than the normal pressure as the steam is being discharged.

The present invention relates to a packaging material, in which a thermally insulating flexible sheet is placed on the surface of the oriented film made of a synthetic resin and affixed thereto partially or over the entire surface. The packaging bag using such a material has functions similar to those of the packaging material in accordance with the present invention and can be used for heating the contents thereof. In the course of heating, the function of adjusting the internal pressure due to the formation of a small hole is not impeded because the thermally insulating flexible sheet is porous and therefore it tends to form local cleavage. Furthermore, the thermally insulating flexible sheet affixed onto the surface has a very low thermal conductivity. Therefore, it has a function of thermally insulating heat generated inside the packaging bag. Therefore, the bag can be handled with bare hands even immediately after heating in a microwave oven, except the zone around the vapor blow-out portion.

A foamed polyethylene sheet, foamed polypropylene sheet, foamed polystyrene sheet, or a non-woven fabric may be used as the thermally insulating flexible sheet to be affixed onto the oriented film surface. Those materials have a small specific gravity and excellent thermal insulating properties. They also have a low level of degradation with time and a high resistant to degradation induced by UV radiation and can be manufactured at a low cost.

The present invention provides a packaging material using a film laminate in which a cutting line is cut in the form of a solid or broken line in a cast film made of a synthetic resin and having heat sealing properties and a thermally insulating flexible sheet is placed on the surface thereof and affixed thereto partially or over the entire surface.

When the packaging bag using such a material is heated in a microwave oven, water contained in the contents thereof, such as food, turns to steam, the inside of the bag is filled with this steam, and the internal pressure is increased. The film temperature is raised accordingly and the sealant is softened. The cast film at the inner side extends and expands in the direction perpendicular to the cutting line as the internal pressure is increased. However, since the thermally insulating flexible sheet affixed to the outer side is difficult to extend, a counteraction is created to a force which acts to cause extension and expansion in the above-mentioned perpendicular direction of the cast film on the cutting line on the adhesive surface. Subsequent increase in the internal pressure produces local cleavage in the thermally insulating flexible sheet located at the outer side and the internal pressure can be adjusted by releasing steam therefrom to the outside.

The invention relates to a packaging material, which comprises a cover provided with an excess portion, a container having the cover affixed thereto with a heat seal, and a flap in which the excess portion dangles from the upper end of the container, wherein the end portion of the flap is adhesively bonded to the container. Bonding of the flap to the container may be conducted at the side surface of the container or at the bottom surface thereof. A heat seal or an adhesive is used for pasting. A specific feature of such a material is that the amount of information about the product can be greatly increased by printing the trade name or properties on the flap.

The invention relates to a packaged product in which processed food, various foods, medical instruments or containers are airtight sealed with the packaging material.

Airtight sealing can protect the contents from bacteria, and if the contents are food, it can be readily cooked by directly heating it in a microwave oven. Furthermore, the packaged product can be directly held with bare hands immediately after heating.

BRIEF DESCRIPTION OF THE DRAWINGS

FIG. 10 is a cross-sectional view along X—X in FIG. 9.

FIG. 16 is a perspective view illustrating the state in which the packaging bag using the material in accordance with the invention is heated.

BEST MODE FOR CARRYING OUT THE INVENTION

The preferred embodiments of the present invention will be described below with reference to the drawings.

Figure 1:
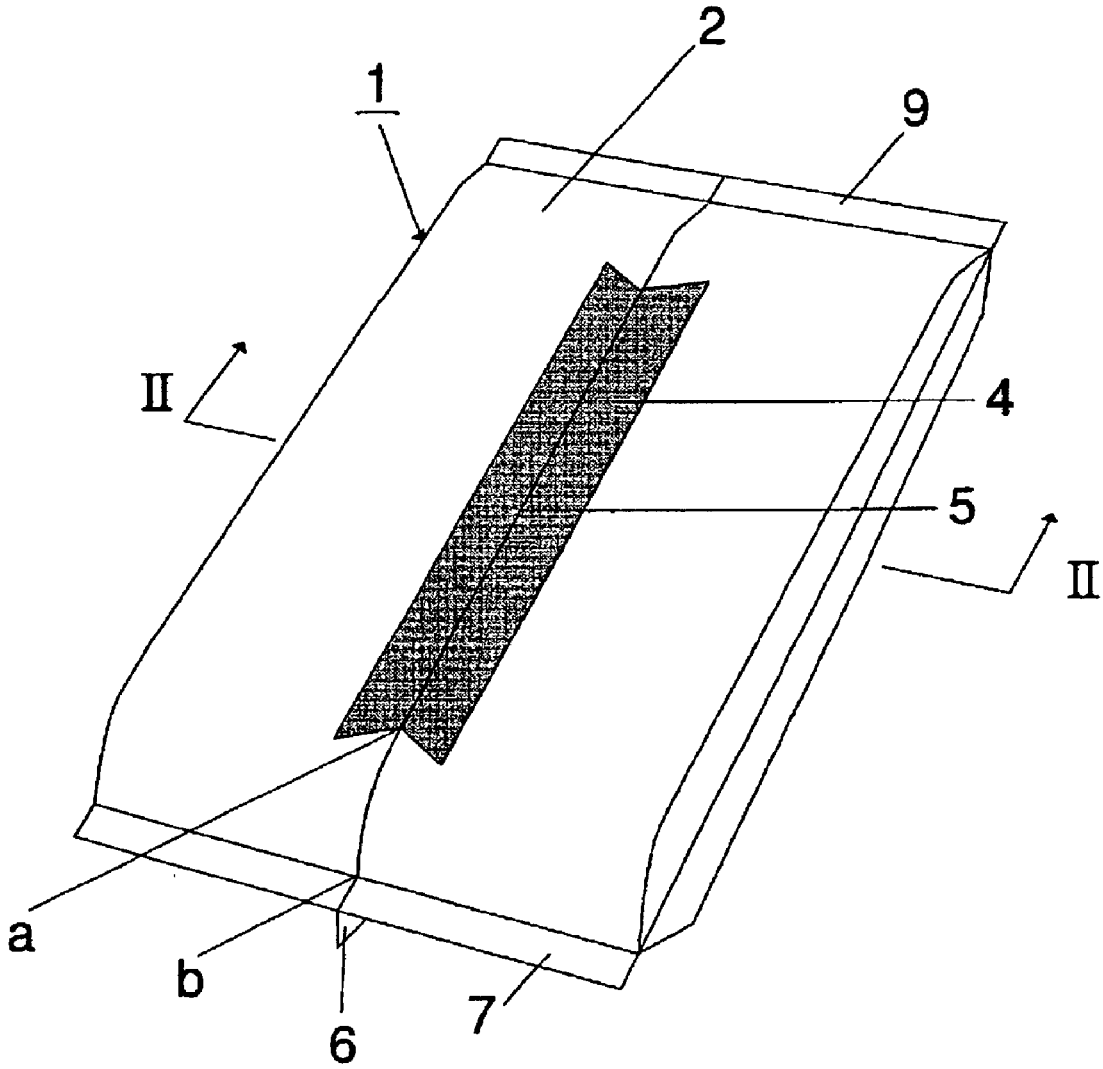
FIG. 1 is a perspective view illustrating an embodiment of the present invention.
Figure 2:
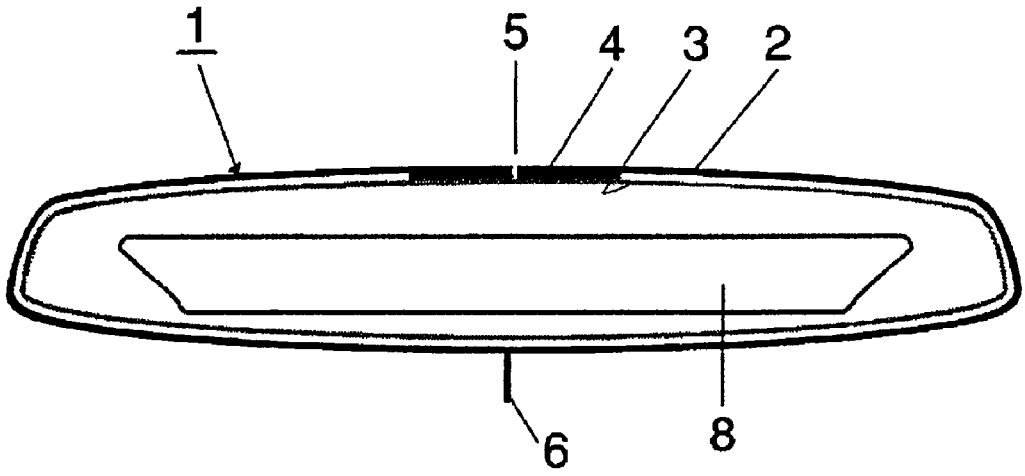
FIG. 2 is a cross-sectional view along II—II in FIG. 1.

FIG. 1 is a perspective view illustrating an embodiment of the packaging bag fabricated by employing the packaging material. FIG. 2 is a cross-sectional view along II—II in FIG. 1. A packaging bag 1, as shown in FIG. 2, was fabricated of an oriented film 2 made of a synthetic resin and a cast film 3 made of a synthetic resin and having heat sealing properties, the cast film 3 being located on the inner side.

A heat sealing agent 4 having a low melting point is coated, as shown in FIG. 1, from the back side on the oriented film 2 located on the surface side of the packaging bag 1 so that both ends thereof are in the shape, for example, of inverted arrow tips within a region of prescribed width and a cutting line 5 is cut in the oriented film 2 so as to pass through the zone where the heat sealing agent 4 was coated.

Then the cast film 3 made of a synthetic resin and having heat sealing properties is placed onto the back side of the oriented film 2 coated with the heat sealing agent 4 having a low melting point and having the cutting line 5 cut therein and the oriented film 2 and cast film 3 are bonded to each other with an adhesive. Furthermore, the left and right sides overlap over a very small width, a longitudinal bonded portion 6 is formed by heat sealing, and a flat tubular shape is obtained. Then, a lateral bonded portion 7 is formed by heat sealing of the front side of the tube in a direction perpendicular to the longitudinal bonded portion 6, as shown in FIG. 1. The formation of the packaging bag 1 with a non-bonded upper edge, as shown in FIG. 1, is thus completed.

Contents 8 (see FIG. 2), such as foods, various food products, medical instruments, or the like, are inserted into the packaging bag 1 from the non-bonded edge side thereof, and if a lateral bonded portion 9 at the upper side shown in FIG. 1 is then formed by heat sealing, the contents 8 are tightly sealed in the packaging bag 1 fabricated by laminating the oriented film 2 and cast film 3.

A release agent may be used instead of the heat-sealing agent 4 as the above-described coating agent applied to the prescribed zone of the oriented film 2.

The process implemented when the packaging bag 1 thus containing the contents 8 in a tightly sealed state is put in a microwave oven and heated therein will be described below.

Figure 3:
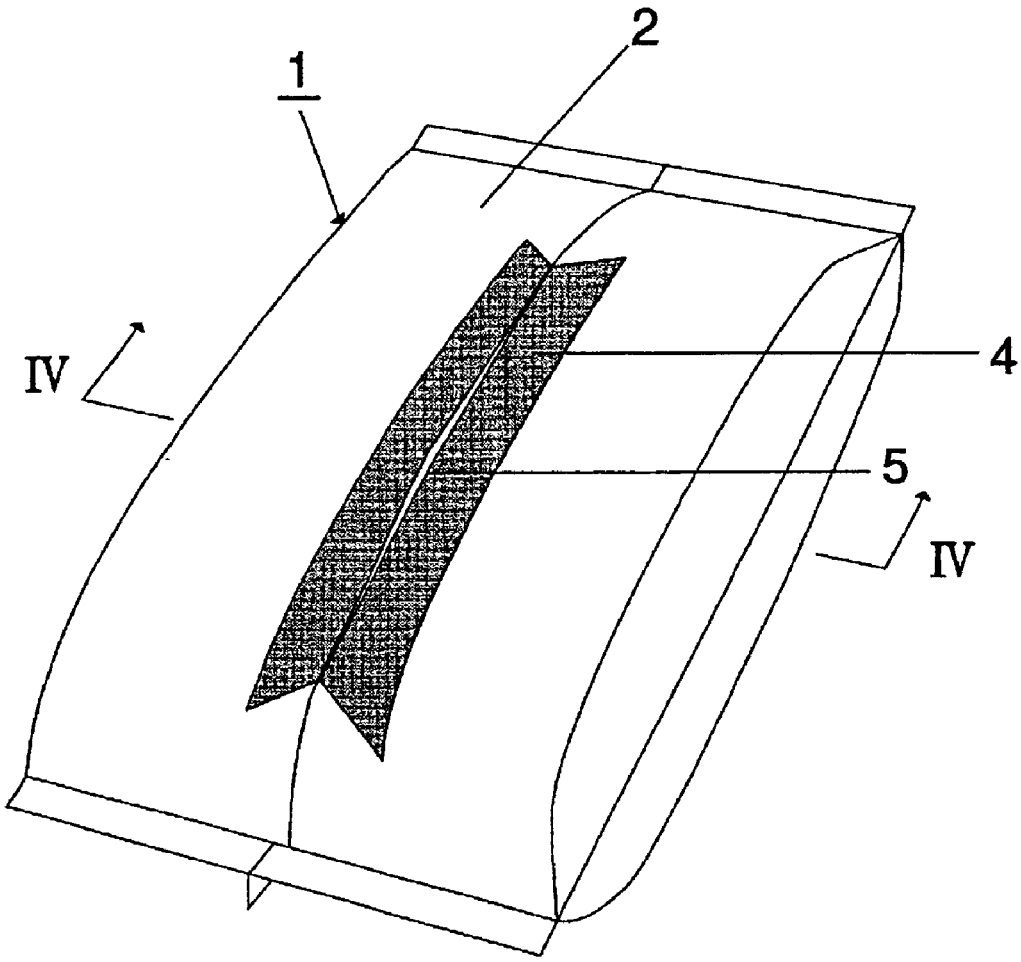
FIG. 3 is a perspective view illustrating the state in which the packaging bag using the material in accordance with the present invention is heated.
Figure 4:
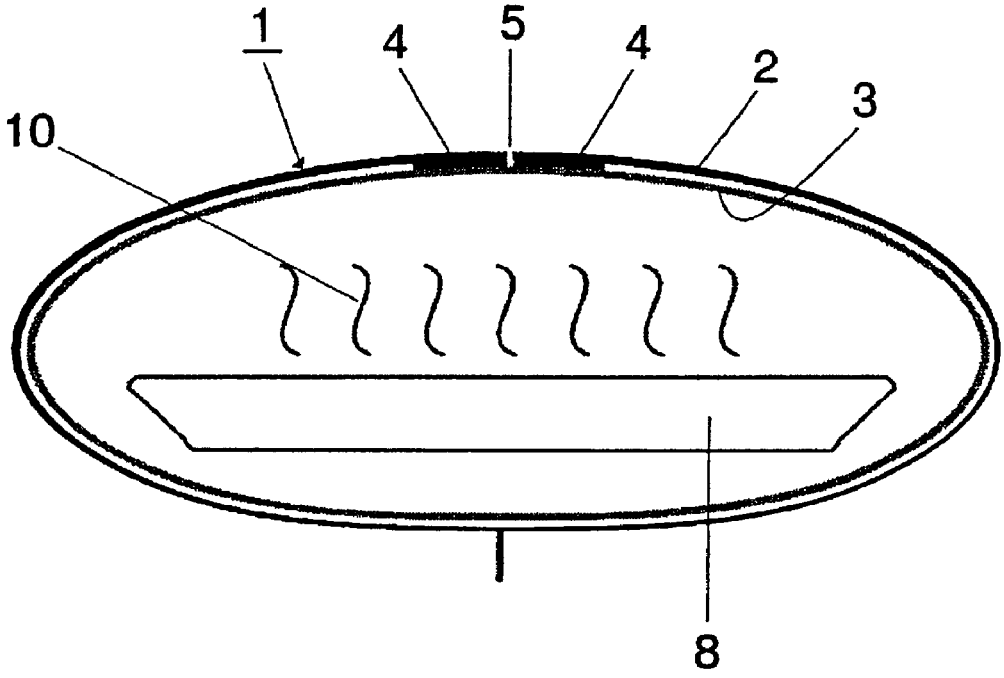
FIG. 4 is a cross-sectional view along IV—IV in FIG. 3.

If the packaging bag 1 is put in a microwave oven and heated therein, water contained in the contents 8 is evaporated, producing steam 10, as shown in FIG. 4, and the steam is mixed with air, thereby raising the pressure inside the packaging bag 1. As a result, the cast film 3 starts to extend in a direction perpendicular to the cutting line 5, as shown in FIG. 3 and FIG. 4, while pushing and expanding the oriented film 2 affixed to the outer side.

Figure 5:
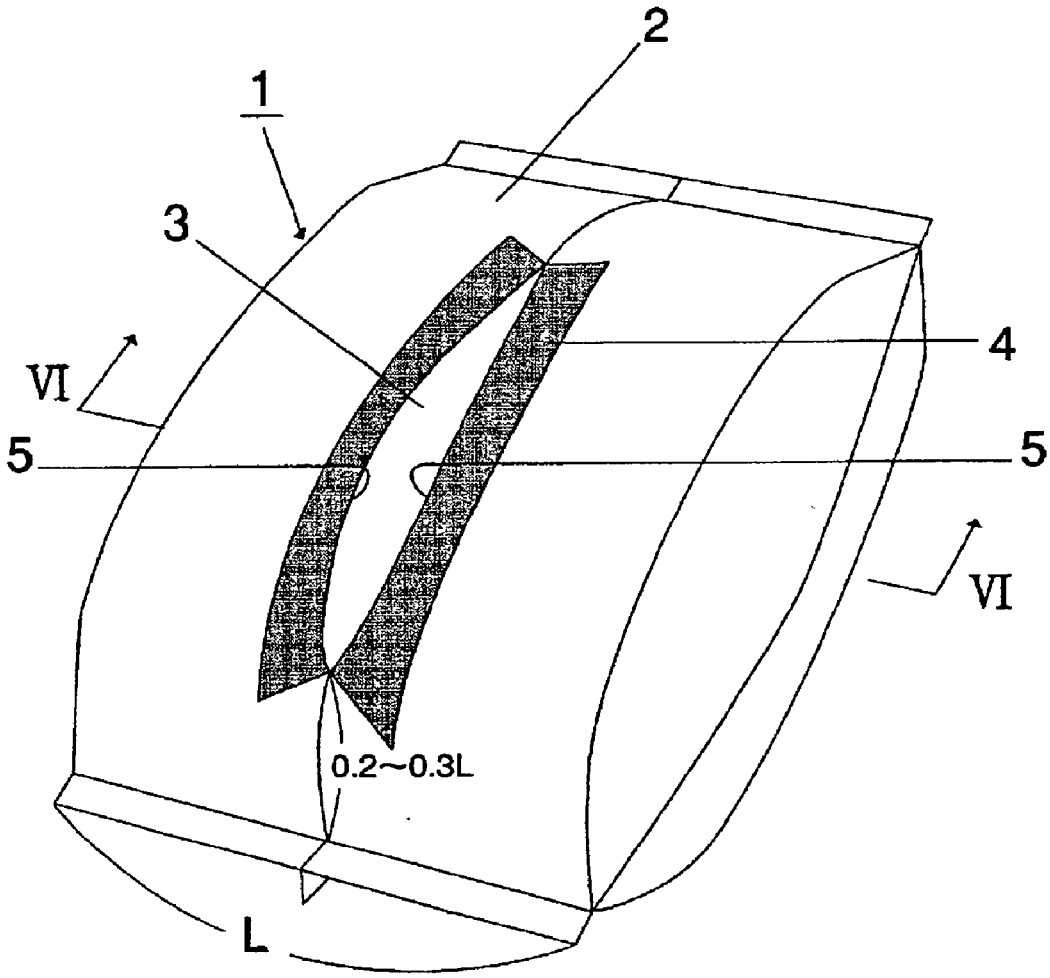
FIG. 5 is a perspective view illustrating a state in which heating of the packaging bag using the material in accordance with the present invention is continued.
Figure 6:
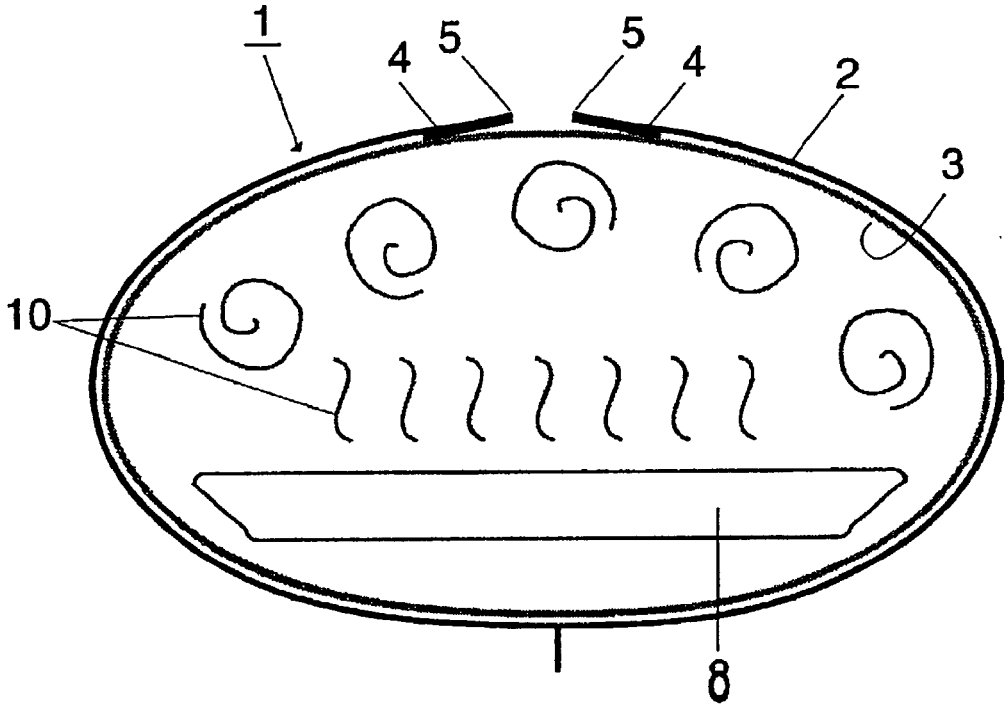
FIG. 6 is a cross-sectional view along VI—VI in FIG. 5.

Since the pressure inside the packaging bag 1 further rises, the cut portion of the oriented film 2 expands, the extending region of cast film 3 expands, separation of the oriented film 2 and the cast film 3 starts from the coated zone as a result of melting of the heat sealing agent 4 with a low melting point in case it was coated or because of low friction ability of the release agent in case it was coated, the cutting line 5 in the zone coated with the heat sealing agent 4 or release agent breaks, as shown in FIG. 5 and FIG. 6, and the oriented film 2 starts to open.

Figure 7:
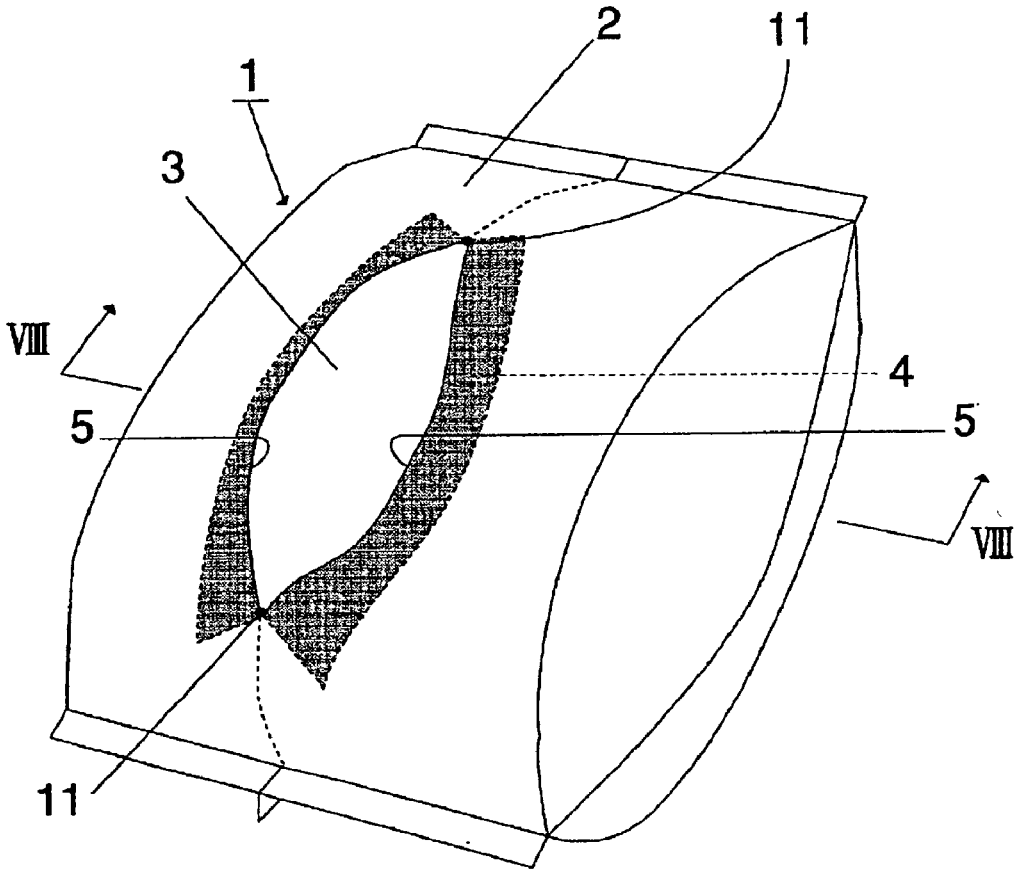
FIG. 7 is a perspective view illustrating a state in which heating of the packaging bag using the material in accordance with the present invention is further continued.

The cast film 3 tends to further extend even after the oriented film 2 starts to open, but only the zone coated with the heat sealing agent 4 or release agent undergoes stretching, whereas other, non-coated portions do not extend. As a result, stresses are concentrated on the boundary between the zone coated with the heat sealing agent 4 or release agent and the zone that has not been coated and will lead to the formation of a small hole 11 in the cast film 3 at both ends of the zone where the cutting line 5 has opened, as shown in FIG. 7.

At this time, the distance between the apex (a) of the inverted arrow tip (see FIG. 1) and the bag seal edge (b) (see FIG. 1) is preferably 0.2–0.3L, where L stands for a bag width (FIG. 5).

Figure 8:
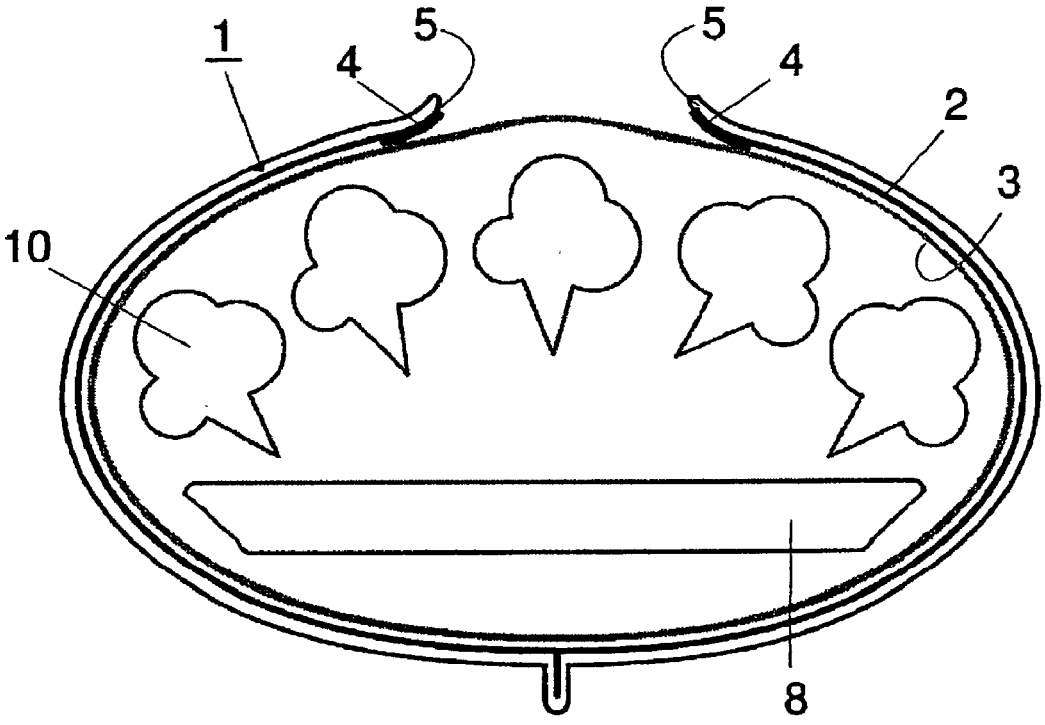
FIG. 8 is a cross-sectional view along VIII—VIII in FIG. 7.

If the small hole 11 is formed in the cast film 3, steam 10 (see FIG. 8) present inside the packaging bag 1 is released to the outside of the packaging bag 1 through the small hole 11 and the zone where the cutting line 5 of the oriented film 2 has opened. Since the steam 10 is released to the outside, the pressure inside the packaging bag 1 drops, the elongation of the cast film 3 decreases, and the small hole 11 decreases in size and becomes almost closed.

If the small hole 11 is closed, the pressure inside the packaging bag 1 rises again, the cast film 3 extends, the small hole 11 increases in size, and the steam 10 present inside the packaging bag 1 is again released to the outside, thereby reducing pressure inside the packaging bag 1.

Thus, because of expansion and shrinkage of the small hole 11, the rise and drop of pressure inside the packaging bag 1 are repeated, the pressure inside the packaging bag 1 is maintained with high stability within a constant range above the normal pressure, and the heating time is shortened by comparison with the conventional process.

When the amount of water in contents 8 is low, if an auxiliary water pad containing water is placed in the packaging bag, water lost during heating is replenished and a sufficient steaming effect is obtained.

Figure 9:
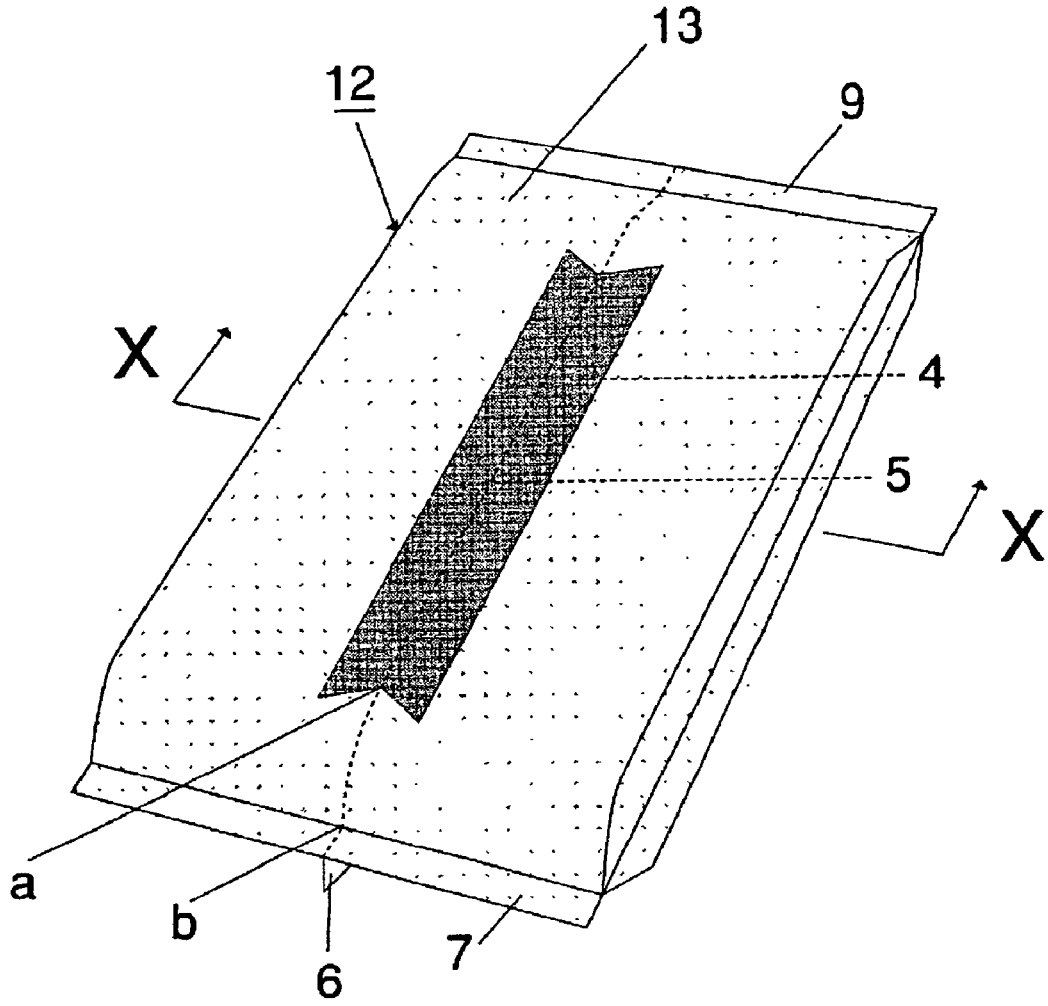
FIG. 9 is a perspective view illustrating an embodiment of the present invention.

FIG. 9 is a perspective view illustrating an embodiment of the invention relating to a packaging bag. FIG. 10 is a cross-sectional view along X—X in FIG. 9. A packaging bag 12 in accordance with the present invention, as shown in FIG. 10, is fabricated by laminating a thermally insulating flexible sheet 13, an oriented film 2 made of a synthetic resin, and a cast film 3 made of a synthetic resin and having heat sealing properties so as to obtain a three-layer structure.

A heat sealing agent 4 having a low melting point is applied to the oriented film 2 side, as shown by a broken line in FIG. 9, so that both ends thereof are in the shape, for example, of inverted arrow tips within a region of prescribed width, and a cutting line 5 is cut in the oriented film 2 so as to pass through the zone where the heat sealing agent 4 was coated. Furthermore, the thermally insulating flexible sheet 13 is affixed onto the outer side of the oriented film 2, as shown in FIG. 10.

On such an arranged oriented film 2, coated from the back side thereof with the heat sealing agent 4 with a low melting point and having a cutting line 5 cut therein, and the thermally insulating flexible sheet 13, the cast film 3 made of a synthetic resin and having heat sealing properties is placed from the side of the oriented film 2 and then the oriented film 2 and cast film 3 are bonded to each other with an adhesive. Furthermore, the left and right sides are overlapped over a very small width, a longitudinal bonded portion 6 is formed by heat-sealing and a flat tubular-shape bag is obtained. Then, a lateral bonded portion 7 is formed by heat sealing of the front side of the bag in the direction perpendicular to the longitudinal bonded portion 6, as shown in FIG. 9. The formation of the packaging bag 12 with a non-bonded upper edge, as shown in FIG. 9, is thus completed.

Contents 8 (see FIG. 10), such as foods, various food products, medical instruments, or the like, are inserted into a packaging bag 12 from the non-bonded edge side thereof, and if a lateral bonded portion 9 at the upper side shown in FIG. 9 is then formed by heat sealing, the contents 8 are tightly sealed with the packaging bag 12 fabricated by laminating a thermally insulating flexible sheet 13, oriented film 2, and cast film 3.

A release agent may be used instead of the heat-sealing agent 4 as the above-described coating agent applied to the prescribed zone of the oriented film 2.

The process implemented when the packaging bag 12 thus containing the contents 8 in a tightly sealed state is put in a microwave oven etc. and heated therein will be described below.

Figure 13:
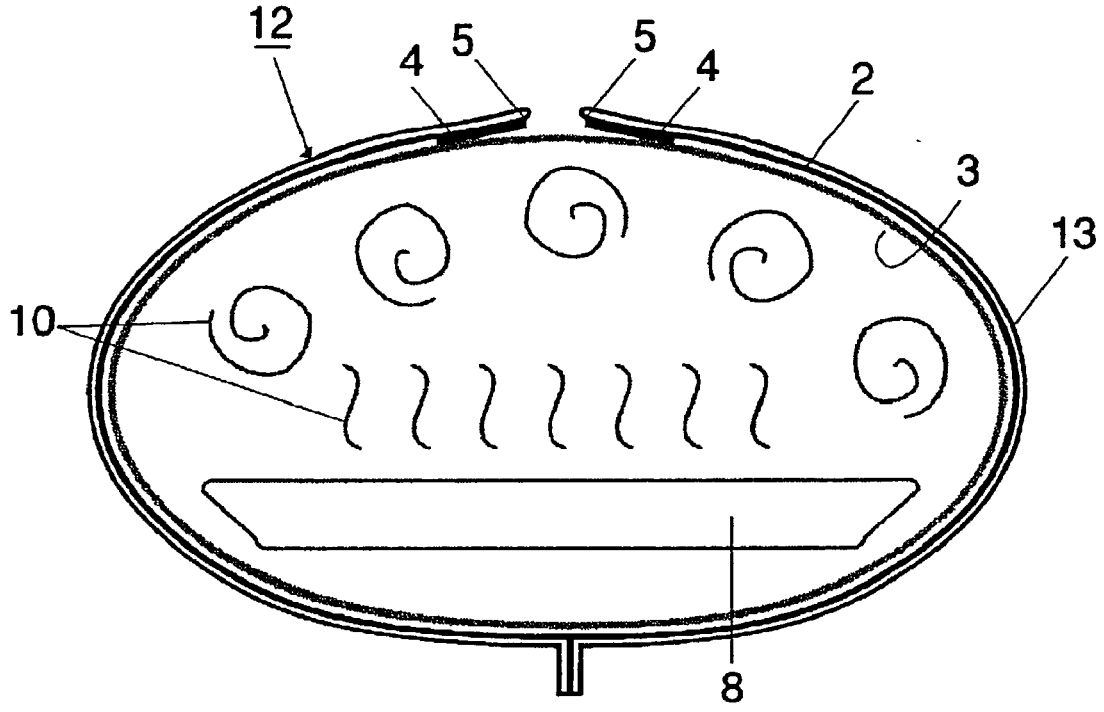
FIG. 13 is a cross-sectional view along XIII—XIII in FIG. 12.
Figure 14:
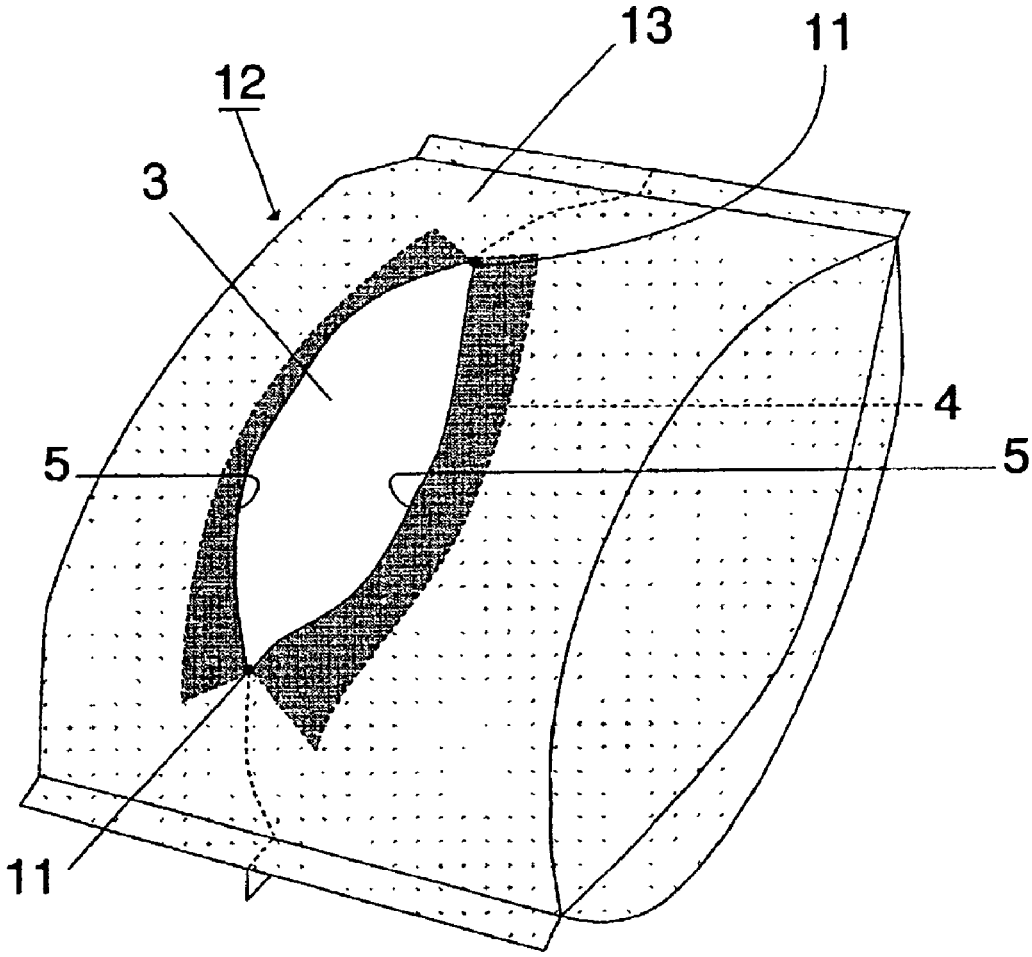
FIG. 14 is a perspective view illustrating a state in which heating of the packaging bag using the material in accordance with the invention is further continued.

If the packaging bag 12 is put in a microwave oven and heated therein, water contained in the contents 8 is evaporated, producing steam 10, as shown in FIG. 13, and the steam is mixed with air, thereby raising the pressure inside the packaging bag 12. As a result, the cast film 3 starts to extend in a direction perpendicular to the cutting line 5, as shown in FIG. 14, while expanding the oriented film 2 bonded as an interlayer and the thermally insulating flexible sheet 13 located at the outer side.

Figure 11:
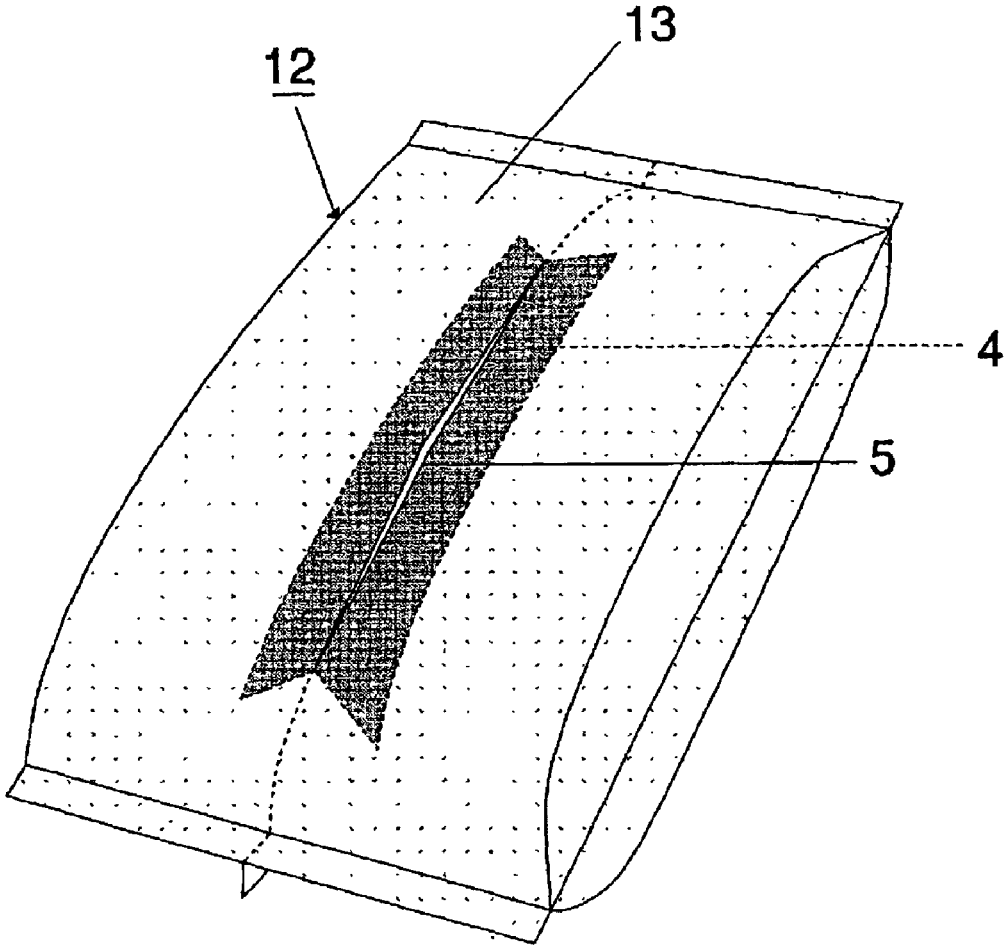
FIG. 11 is a perspective view illustrating the state in which the packaging bag using the material in accordance with the invention is heated.

Since the pressure inside the packaging bag 12 further rises, the cut portion 5 of the oriented film 2 expands and a rift appears in the thermally insulating flexible sheet 13 located at the outer side and bonded to the oriented film. Furthermore, as the extending region of the cast film 3 expands, separation of the oriented film 2 and the cast film 3 starts from the coated zone as a result of melting of the heat sealing agent 4 with a low melting point in case it was coated or because of low friction property of the release agent in case it was coated, the cutting line 5 in the zone coated with the heat sealing agent 4 or release agent breaks, as shown in FIG. 14, and the thermally insulating flexible sheet 13 in FIG. 11, and the oriented film 2 start to open.

Figure 12:
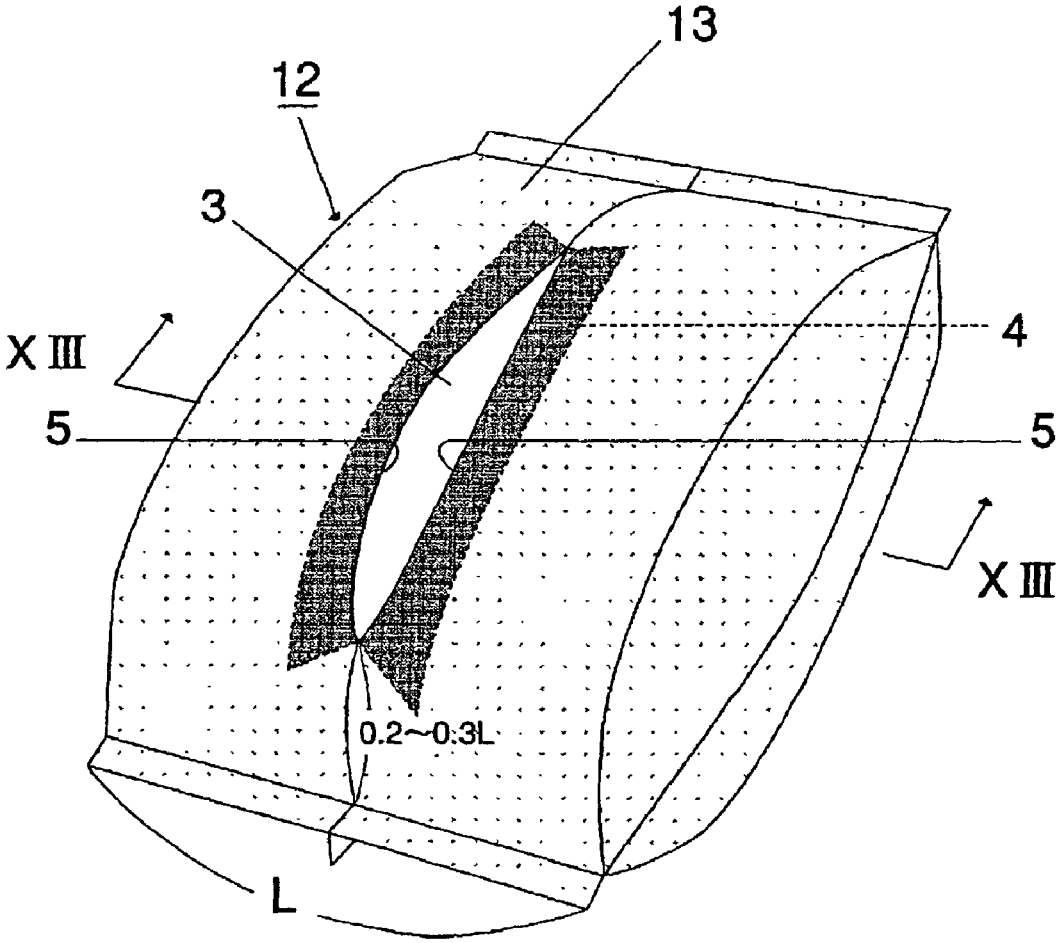
FIG. 12 is a perspective view illustrating a state in which heating of the packaging bag using the material in accordance with the invention is continued.

The cast film 3 tends to extend even after the thermally insulating flexible sheet 13 and oriented film 2 start to open, but only the zone coated with the heat sealing agent 4 or release agent undergoes stretching, whereas other, non-coated portions do not extend. As a result, stresses are concentrated on the boundary between the zone coated with the heat sealing agent 4 or release agent and the zone that was not coated therewith and will lead to the formation of a small hole 11 in the cast film 3 at both ends of the zone where the cutting line 5 was opened, as shown in FIG. 14. At this time, the distance between the apex (a) of the inverted arrow tip (see FIG. 9) and the bag seal edge (b) (see FIG. 9) is preferably 0.2–0.3L, where L stands for a bag width (FIG. 12).

If the small hole 11 is formed in the cast film 3, steam 10 (see FIG. 13) present inside the packaging bag 12 is released to the outside of the packaging bag 12 through the small hole 11 and the zone where the cutting line 5 of the oriented film 2 has opened. Since the steam 10 is released to the outside, the pressure inside the packaging bag 12 drops, the elongation of the cast film 3 decreases, and the small hole 11 decreases in size and become almost closed.

If the small hole 11 is closed, the pressure inside the packaging bag 12 rises again, the cast film 3 extends, the small hole 11 increases in size, and the steam 10 present inside the packaging bag 12 is again released to the outside, thereby reducing the pressure inside the packaging bag 12.

Thus, because of expansion and shrinkage of the small hole 11, the rise and fall of the pressure inside the packaging bag 12 are repeated, the pressure inside the packaging bag 12 is maintained with a high stability within a constant range above the normal pressure, and the heating time is shortened by comparison with the conventional process.

When the amount of water in contents 8 is low, if an auxiliary water pad containing water is placed in the packaging bag, water lost during heating is replenished and a sufficient steaming effect is obtained.

Figure 15:
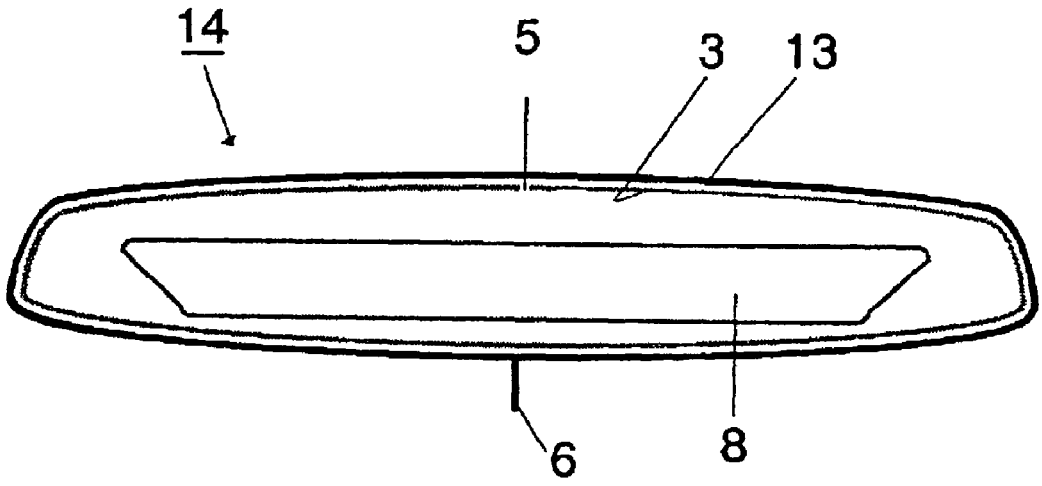
FIG. 15 is a cross-sectional view illustrating an embodiment of the present invention.

FIG. 15 is a cross-sectional view illustrating an embodiment of the invention relating to a packaging bag. A packaging bag 14 in accordance with the present invention, as shown in FIG. 15, is fabricated by laminating a thermally insulating flexible sheet 13 and a cast film 3 made of a synthetic resin and having heat sealing properties so as to obtain a two-layer structure.

Thus, the cast film 3 made of a synthetic resin and having heat sealing properties that was provided with a cutting line 5 is laminated on the thermally insulating flexible sheet 13, and the thermally insulating flexible sheet 13 and cast film 3 are bonded to each other with an adhesive, etc. Furthermore, the left and right sides are overlapped over a small width, a longitudinal bonded portion 6 is formed by heat sealing and a flat tubular shape flag is obtained. Then, a lateral bonded portion 7 is formed by heat sealing of the front side of the tube in a direction perpendicular to the longitudinal bonded portion 6, as shown in FIG. 16. The formation of the packaging bag 14 with a non-bonded upper edge, as shown in FIG. 16, is thus completed.

contents 8 (see FIG. 15) such as foods, various food products, medical instruments or the like are inserted into the packaging bag 14 from the non-bonded edge side thereof, and if a lateral bonded portion 9 at the upper side shown in FIG. 16 is then formed by heat sealing, the contents 8 are tightly sealed in the packaging bag 14 fabricated by laminating the thermally insulating flexible sheet 13 and cast film 3.

The process implemented when the packaging bag 14 thus containing the contents 8 in tightly sealed state is put in a microwave oven and heated therein will be described below.

Figure 17:
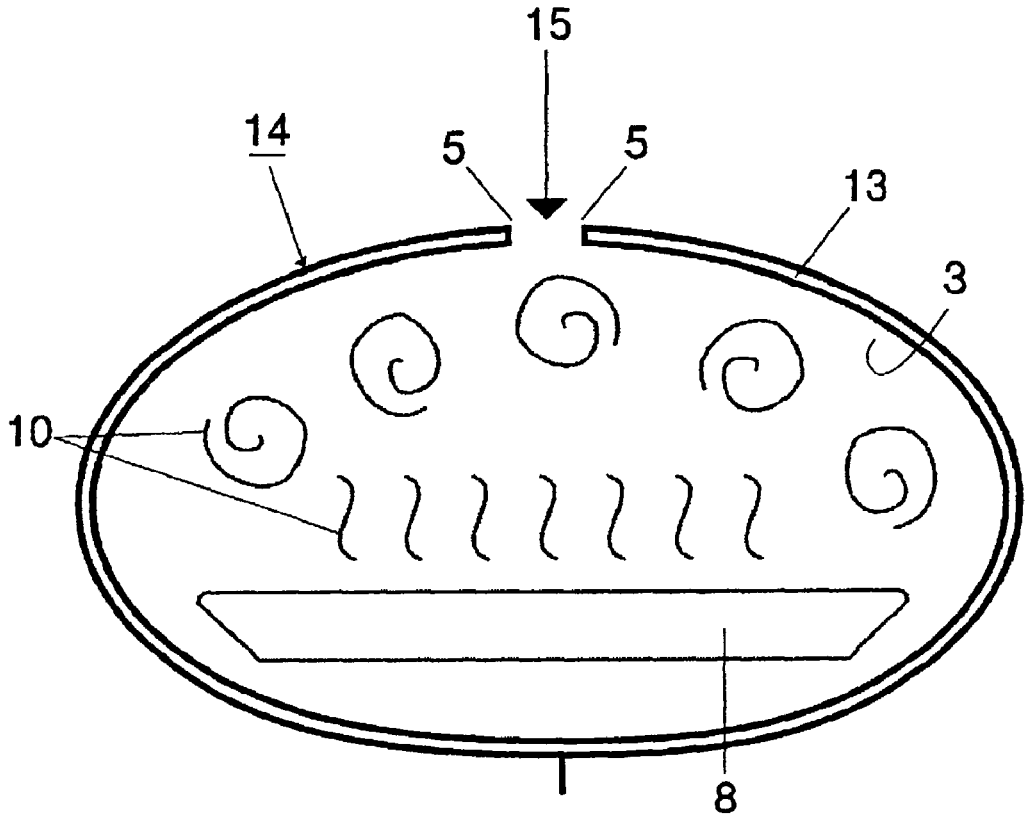
FIG. 17 is a cross-sectional view along XVII—XVII in FIG. 16.

If the packaging bag 14 is put in a microwave oven, etc. and heated therein, water contained in the contents 8 is evaporated, producing steam 10, as shown in FIG. 17, and the steam is mixed with air, thereby raising the pressure inside the packaging bag 14. As a result, the cast film 3 starts to extend in a direction perpendicular to the cutting line 5, as shown in FIG. 16 and FIG. 17, while expanding the thermally insulating flexible sheet 13 located at the outer side.

Since the pressure inside the packaging bag 14 further rises, the cut portion 5 of the cast film 3 expands and a rift appears in the thermally insulating flexible sheet 13 located at the outer side. Furthermore, since the cut portion 5 of the cast film 3 expands in a perpendicular direction, the thermally insulating flexible sheet 13 starts to open.

If the thermally insulating flexible sheet 13 is opened, steam 10 (see FIG. 17) present inside the packaging bag 14 is released to the outside of the packaging bag 14 through the opening portion 15. Since the steam 10 is released to the outside, the pressure inside the packaging bag 14 drops, the elongation of the cast film 3 decreases, and the opening portion 15 decreases in size and becomes almost closed.

If the opening portion 15 is closed, pressure inside the packaging bag 14 rises again, the cut portion 5 of the cast film 3 expands and enlarges the opening portion 15 of the thermally insulating flexible sheet, and the steam 10 present inside the packaging bag 14 is again released to the outside, thereby reducing pressure inside the packaging bag 14.

Thus, because of expansion and shrinkage of the opening portion 15, the rise and drop of the pressure inside the packaging bag 14 are repeated, the pressure inside the packaging bag 14 is maintained with high stability within a constant range above the normal pressure, and the heating time is shortened by comparison with the conventional process.

When the amount of water in the contents 8 is low, if an auxiliary water pad containing water is placed in the packaging bag, water lost during heating is replenished and sufficient steaming effect is obtained.

Figure 18:
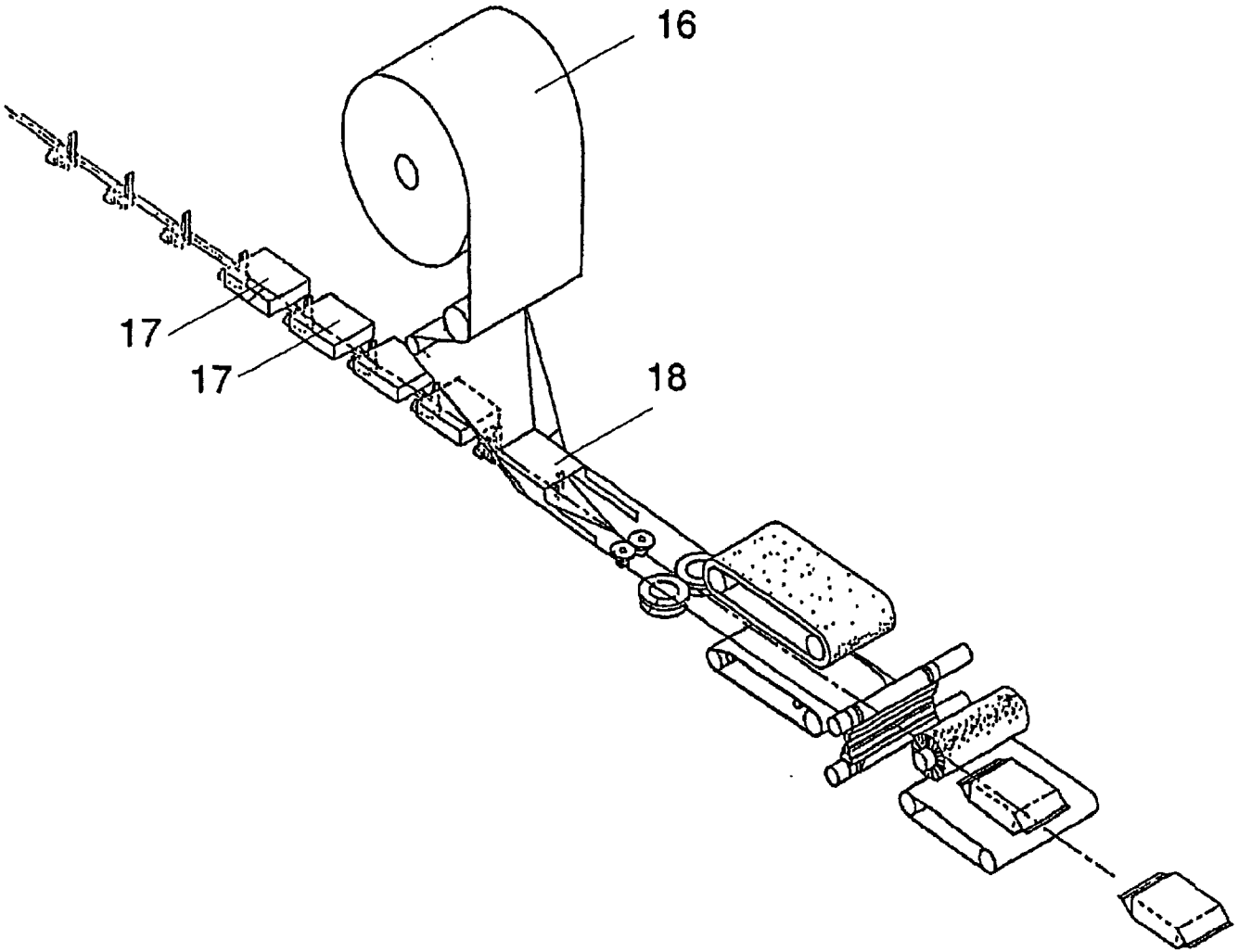
FIG. 18 illustrates an automatic packaging machine using the product in accordance with the present invention.

The laminated film 16 in accordance with the present invention, which is provided with the above-described structure and functions, can be wound into a roll and supplied for automatic packaging of food products 17. For example, as shown in FIG. 18, in a lateral pillow-type automatic packaging machine, food products 17 are wrapped up to obtain cylindrical packages in a packaging unit 18 and continuously heat sealed at the back portion. Then, the portions located at the front and rear portions are heat-sealed at a right angle to the back seal, the heat-sealed portions are cut at the central portions and packaging is completed. Since the portion which is to open when heating in a microwave oven is located at the surface portion of the bag other than the portions used for heat-sealing the packaging bag, the above heat-sealed portions are not affected by this heating in a microwave. The above-described film can be employed by the food manufacturers, without limitations being placed by types and systems of automatic packaging machines used by the manufacturers.

An embodiment in which the packaging material in accordance with the present invention was used for a packaging bag will be described below.

EXAMPLE 1

Embodiment Relating to a Packaging Bag

A packaging bag of a low-melting heat seal type shown in FIG. 1 was fabricated by using a polyester film having a thickness of 20 μm as an oriented film (outer material) and a polyethylene film having a thickness of 40 μm as a cast film (inner material). In a test, the bag was used for packaging, as a content, four tissues (made of Nepia, manufactured by Oji Paper Co., Ltd.) impregnated with tap water to a water content of 10–40 cc. The size of the bag was shown in FIG. 19. The packaged bag was placed in a microwave oven (EMO-MRL (HL) type, high-frequency output 500 W, turn table diameter 300 mm, manufactured by Sanyo Electric Co., Ltd.) and heated therein. Steam was generated in the course of heating, the internal pressure was increased, and in a short time it was observed that a small hole 11 was formed. In this test, the water content of the packaged product was changed, and the time until the small hole was formed at the cutting line of the oriented film and the maximum opening width observed when the film was opened along the cutting line were measured. The measurements were conducted twice, immediately after the packaging bag was manufactured (Table 1) and in 10 days after it was manufactured (Table 2).

TABLE 1

| Water content (cc) | Time until the formation of small hole (s) | Opening width (mm) | State of small hole |
|---|---|---|---|
| 10 | 35 | 20 | ⊙ |
| 20 | 40 | 19 | ⊙ |
| 30 | 44 | 19 | ⊙ |
| 40 | 52 | 18 | ⊙ |

TABLE 2

| Water content (cc) | Time until the formation of small hole (s) | Opening width (mm) | State of small hole |
|---|---|---|---|
| 10 | 32 | 18 | ⊙ |
| 20 | 33 | 18 | ⊙ |
| 30 | 41 | 22 | ⊙ |
| 40 | 54 | 19 | ⊙ |

In the tables the symbol ⊙ relating to the state of the small hole represents a state in which the small hole was formed in the cast film at a boundary line between the surface coated with a heat seal agent and the present coated surface, as was expected, and the steam present inside the packaging bag was released to the outside of the packaging bag with good stability.

A packaging bag fabricated from the packaging material of a low-melting heat seal type in accordance with the present invention was then used for repackaging of various commercial frozen foods, the time until a small hole was formed was measured under the same conditions as described above, and the state of the small hole was observed. The results are presented in Table 3 below.

TABLE 3

| Food name (manufacturer) | Weight of one bag (g) | Moisture content (%) | Time taken until the formation of small hole (min) | State of small hole |
|---|---|---|---|---|
| Imagawayaki (Japanese muffin containing bean jam) (Nichirei) | 81.0 | 35.5 | 1:28 | ⊙ |
| Anman (Steamed bun containing bean paste) (Katokichi) | 82.4 | 31.5 | 1:30 | ⊙ |
| Steamed meat bun (nikuman) (Imuraya) | 84.0 | 51.0 | 1:43 | ⊙ |
| Takoyaki (Octopus dumpling) (Nissui) | 112.0 | 68.0 | 1:52 | ⊙ |
| Pizaman (Pizza bun) (Yamazaki) | 114.0 | 37.0 | 1:28 | ⊙ |
| Sauteed Napolitan spaghetti (Nisshin Foods) | 180.0 | 54.0 | 2:00 | ⊙ |
| Umai Gohan (steamed rice) (S&B Foods) | 200.0 | 56.0 | 2:50 | ⊙ |
| Shrimp dumpling (Ajinomoto) | 225.0 | 42.5 | 2:11 | ⊙ |
| Mukashinagarano Noren Chahan (fried rice) (Katokichi) | 500.0 | 54.0 | 3:50 | ⊙ |

The results of the above-described tests provided the following information.

1) As was expected, a small hole was formed at the boundary line between the surface coated with the heat seal agent and the non-coated surface and heating of the packaged product was completed, without rupturing the packaging bag, in all cases in which the water-containing tissues and various frozen foods were packaged.

2) As apparent from the test results relating to water-containing tissues, when the heat seal agent coating width was 30 mm, the opening width of the oriented film at the cutting line was 18–22 mm and was stable within a range of 60–70% of the heat seal agent coating width.

3) Comparison of Table 1 and Table 2 shows that the opening function of the packaged bag during heating in a microwave oven did not change with time, and stable results were obtained for the time until the small hole was formed, the opening width, and the opening state.

4) As a rule, direct proportional relationship is observed between the content of water and the required time until opening.

EXAMPLE 2

Embodiment Relating to a Packaging Bag

Figure 19:
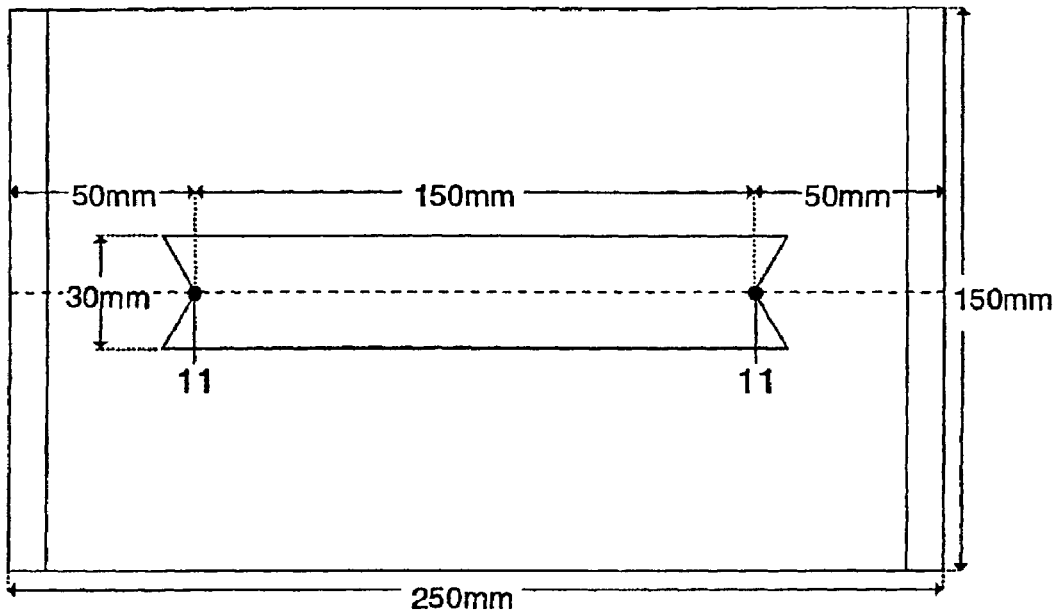
FIG. 19 illustrates the size of samples used for the test in the embodiment of the packaging bag.

A packaging bag of a low-melting heat seal type shown in FIG. 9 was fabricated by using a foamed polyethylene sheet having a thickness of 300 μm as a thermally insulating flexible sheet (outer material), a polyester film having a thickness of 20 μm as an oriented film (intermediate material), and a polyethylene film having a thickness of 40 μm as a cast film (inner material). In a test, the bag was used for packaging four tissues (made of Nepia, manufactured by Oji Paper Co., Ltd.) impregnated with tap water to a water content of 10–40 cc. The size of the bag is shown in FIG. 19. The packaged bag was placed in a microwave oven (EMO-MRI (HL) type, high-frequency output 500 W, turn table diameter 300 mm, manufactured by Sanyo Electric Co., Ltd.) and heated therein. Steam was generated in the course of heating, the internal pressure was increased, and in a short time an opened state of a small hole 11 was detected. In this test, the water content of the packaged product was changed, and the time until the small hole was formed in the oriented film and the maximum opening width observed when the film was opened along the cutting line were measured.

A packaging bag fabricated from the packaging material of a low-melting heat seal type in accordance with the present invention was then used for repackaging of various commercial frozen foods, the time taken until the small hole was formed was measured as well as the above-mentioned maximum opening width under the same conditions as described above, and the state of the small hole was observed.

The results relating to the time until the small orifice were opened and the maximum opening width during opening that were obtained in the tests conducted in Example 2 were found to be almost identical to those obtained in Example 1.

Furthermore, the effective temperature immediately after microwave heating was clearly below the level that somehow hindered handling of the packaging bag with bare hands when it was removed from the microwave oven immediately after heating.

EXAMPLE 3

Embodiment Relating to a Packaged Product

A packaging bag (foamed PE+CPP film provided with a cutting line) shown in FIG. 15 was fabricated by using a foamed polyethylene sheet having a thickness of 300 μm as a thermally insulating flexible sheet (outer material) and a polypropylene film having a thickness of 40 μm as a cast film (inner material) having a cutting line cut therein. Commercial sweet potatoes were placed into the packaging bag and sealed therein to obtain a packaged product. The packaged product was placed in a microwave oven with a high-frequency output of 1500 W and heated for 2 min. Steam was generated in the course of heating and the internal pressure has increased. Eventually a rift appeared in the external foamed polyethylene sheet and an open state was confirmed. In this test, the weight of potatoes before and after the heating was measured, the loss of water on evaporation caused by heating was calculated, and the central temperature of the heated product was measured.

Comparative tests with the packaged products using other packaging materials were conducted. Thus, the comparative examination under the same conditions as described above was conducted on a packaged product obtained by placing potatoes in a polypropylene tray (PP tray), packaging them with a vinyl chloride wrapping film (manufactured by Mitsubishi Jushi K.K.) and heating them in a microwave oven and another packaged potatoes obtained by placing potatoes in a polypropylene tray and directly heating them in a microwave oven.

The packaged products of the above-described three types were removed from the microwave oven immediately after heating and organoleptic examination of the feel to the touch and taste was conducted by testers who directly touched the products removed from the oven and then tasted the potatoes removed from the bag. The results are presented in Table 4.

TABLE 4

Content: Sweet Potatoes, Heating: 1500 W × 2 min

| Packaging material | Before heating | After heating | Reduction percentage | Effective temperature | temperature of central part | Taste |
|---|---|---|---|---|---|---|
| Vinyl chloride wrapping film + PP tray | 205 | 160 | 22% | x | 90° C. | too dry |
| PP tray | 205 | 166 | 20% | x | 90° C. | too dry |
| Foamed PE + CPP film provided with a cutting line | 205 | 172 | 16% | ⊙ | 91° C. | hot and tasty |

Then, commercial potatoes were placed in the packaging bags or containers of the above-described three types and packaged products were obtained. The packaged products were heated for 1 min and 30 s in a microwave oven with a high-frequency power of 1500 W and measurements of the amount of generated steam and central temperature and the organoleptic test were conducted in the above-described manner. Furthermore, comparative tests were conducted with the packaged products using the other packaging materials in the above-described manner. The results are presented in Table 5.

TABLE 5

Content: Potatoes
Heating: 1500 W × one and a half minutes

| Packaging material | Before heating | After heating | Reduction percentage | Effective temperature | temperature of central part | Taste |
|---|---|---|---|---|---|---|
| Vinyl chloride wrapping film + PP tray | 127 | 92 | 28% | x | 87° C. | slightly excessive loss of moisture |
| PP tray | 127 | 97 | 24% | x | 88° C. | Excessive loss of moisture |
| Foamed PE + CPP film provided with a cutting line | 135 | 111 | 18% | ⊙ | 89° C. | proper moisture and hot |

The symbol (x) in the effective temperature column shows a state in which the packaged product could not be held with bare hands immediately after heating it in a microwave oven, and the symbol (⊙) shows a state in which the packaging bag removed from the microwave oven immediately after heating could be readily held with bare hands.

The above-described comparative examination showed the following results.

1) The comparison of the weight reduction percentages demonstrated that the lowest weight reduction percentage was in the packaged product using the foamed PE+CPP film provided with a cutting line. Therefore, it was established that in the packaging bag using the foamed PE+CPP film provided with a cutting line, the sweet potatoes and potatoes as the contents were heated, while retaining the water, and appropriate pressure adjustment was conducted by the opening function. Thanks to this function, the packaged products using the foamed PE+CPP film provided with a cutting line were prepared as a hot product without being excessively dried unlike the packaged products using other containers.

2) Since the appropriate steaming proceeded inside the thermally insulating material, the contents were prepared uniformly with a uniform steaming effect.

3) Among the above packaged products, the packaged product using the foamed PE+CPP film provided with a cutting line showed the highest central temperature of potatoes after heating. It was found from this that the thermally insulating material, which served as an outer material on the foamed PE+CPP film provided with a cutting line, prevented heat dissipation and thereby exhibited an excellent temperature elevation effect.

EXAMPLE 4

Embodiment Relating to a Container Cover

Figure 20:
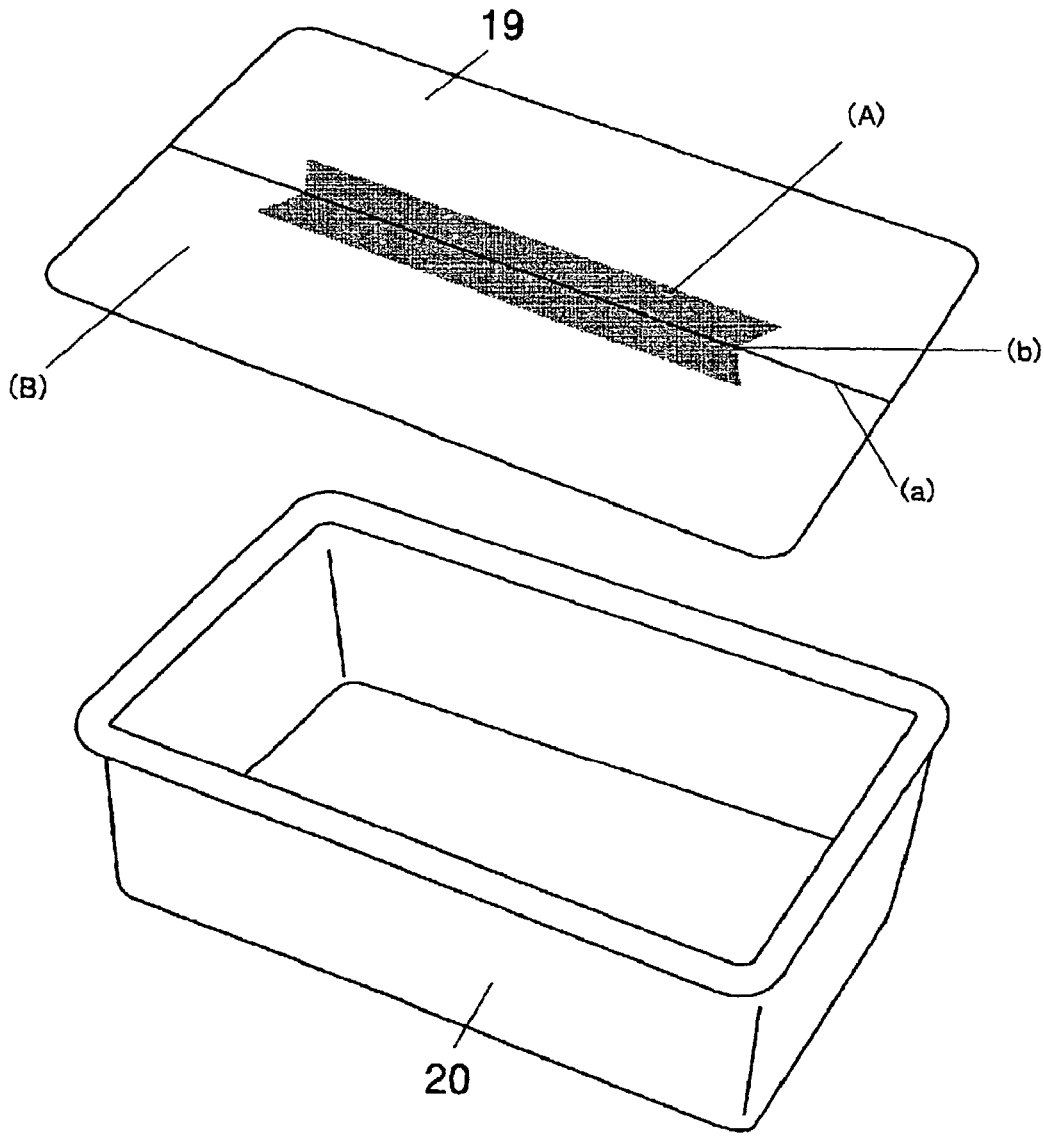
FIG. 20 illustrates an embodiment in which the material of the invention is employed as a container cover.

A heat-resistant container 20 made of a polypropylene resin and having a shape with a width of 115 mm, a length of 128 mm, and a height of 40 mm, as shown in FIG. 20, was filled with Japanese hotchpotch (oden) consisting of 107 g of solid ingredients and 113 cc of soup, and was heat-sealed with a cover film 19 having a portion (A) coated with a low melting-point sealing agent and a cutting line (a). The cover film 19 used herein was constituted by layers of an oriented polyethylene terephthalate (PET) film of 12 μm and a cast polypropylene (CPP) of 30 μm.

When this product was heated by a microwave oven at 500W, the cover film 19 started gradually expanding after 55 seconds, the cutting line (a) widened after 70 seconds, and the small hole was formed at the bag seal edge (b) after 75 seconds, whereby steaming was started with steam being discharged from the small hole. This process was performed stably without any boil-over. The heating was halted after 90 seconds, the container 20 was taken out, and it was confirmed that the hotchpotch had been sufficiently heated.

EXAMPLE 5

Embodiment Relating to a Packaging Material having a Flap

Figure 21:
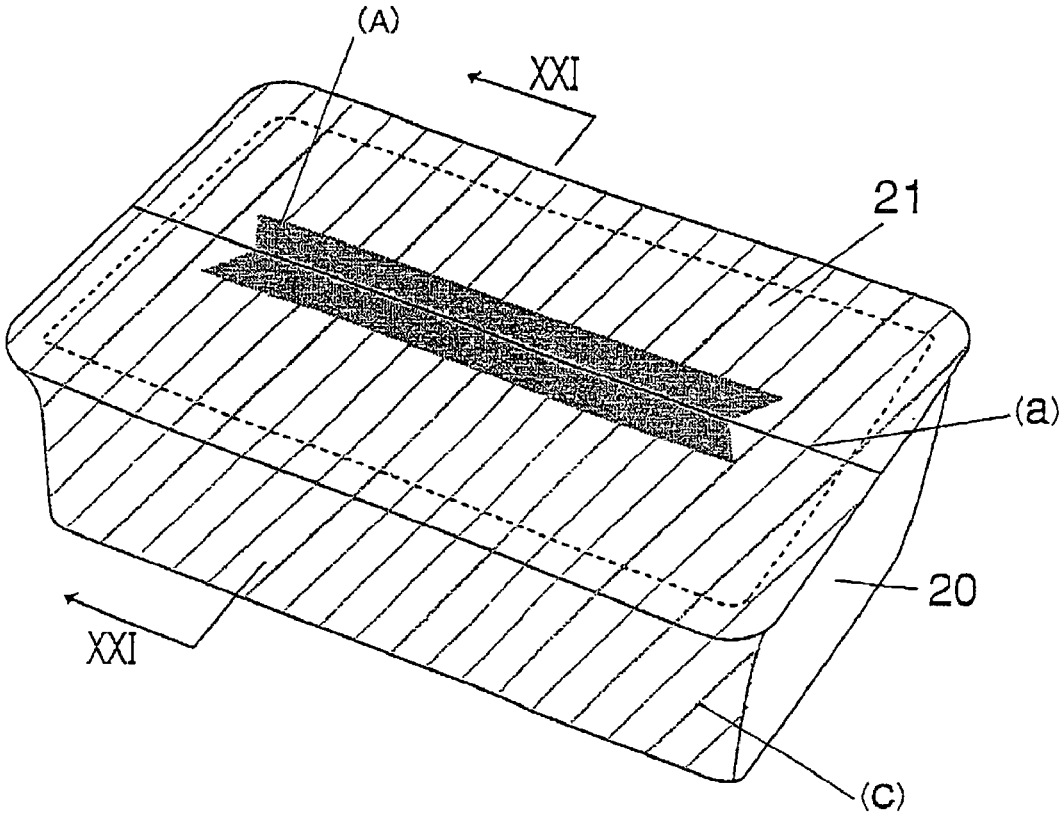
FIG. 21 is a perspective view illustrating an example of a packaging container using the invention.
Figure 22:
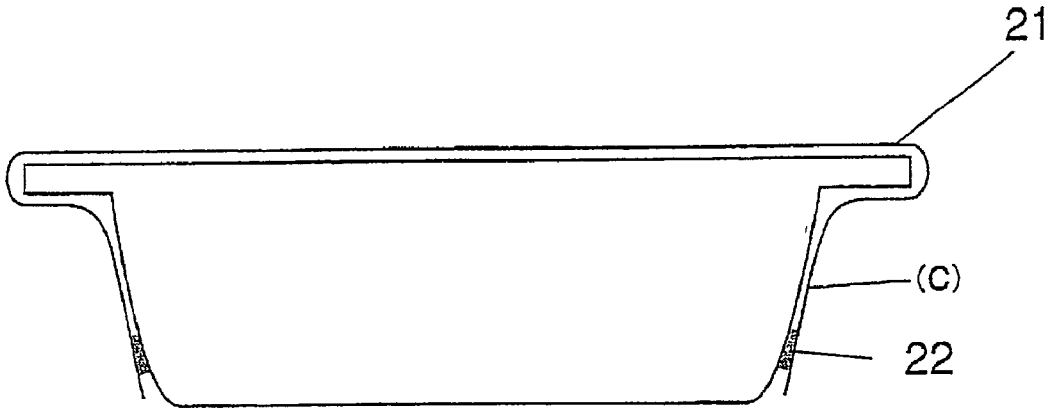
FIG. 22 is a cross-sectional view along XXI—XXI in FIG. 21.

A heat-resistant container 20 made of a polypropylene resin and having a shape with a width of 115 mm, a length of 128 mm, and a height of 40 mm, as shown in FIG. 21, was bonded to and heat sealed with a cover film 21 having a portion (A) coated with a sealing agent having a low melting point and a cutting line (a) and also a flap (c). The flap (c) was bonded with an adhesive 22 to side surfaces of container 20, as shown in FIG. 22. Printing was conducted over the entire surface of the cover film 21 and the surface area where printing was possible was measured. The printing surface area on the cover portion (top surface) was 147.2 $cm^2$, and the printing surface area on the side surface of the container was 102.4 $cm^2$. Therefore, the total surface area of printing was 249.6 $cm^2$. Thus, the surface area where printing was possible in the packaging material having the flap (c) was by a factor of 1.696 higher than that in the packaging material having no flap, and the quantity of product information could be increased by 69.6%.

INDUSTRIAL APPLICABILITY

The invention makes it possible to maintain the internal steam pressure during heating at an almost constant level higher than the normal pressure. Therefore, the heating time can be shortened. A small hole can be formed at portions other than the heat seal portion, the contents do not leak to the outside during heating, and automatic packaging can be readily conducted by the product manufacturers.

In addition, the invention makes it possible to hold the packaging bag with bare hands immediately after heating because of the function of the thermally insulating flexible sheet.

The invention also makes it possible to manufacture a packaging bag rapidly and at a low cost.

The invention makes it possible to seal fluid or semi-fluid materials as the contents and to supply the packaged materials to market.

Furthermore, the product information can be placed not only on the cover portion of the packaging container but also on the body thereof.

The invention provides a packaged product that can be heated in a microwave oven in a sealed state. Therefore, the packaged product can be used in an easy and sanitary manner in convenience stores, side dish markets, medical institutions or the like.

The invention claimed is:

1. A packaging material suitable for use as a substrate for packaging bags or packaging containers employed in heat treatment or thermal sterilization processes, said packaging material comprising a film laminate in which a heat sealing agent with a low melting point is coated on a prescribed zone of an oriented film made of a synthetic resin, a cutting line is cut in the oriented film in the form of a solid or broken line passing through the zone coated with the heat sealing agent, and a cast film made of a synthetic resin and having heat sealing properties is affixed to the oriented film, wherein when the packaging material is subjected to stress acting in a direction perpendicular to the cutting line in the zone coated with the heat sealing agent, the cast film extends and expands in the direction of the stress and when the cast film is incapable of further extension and expansion, a small hole forms therein at both ends of the cutting line, each of said small holes being capable of elastically expanding and shrinking.

2. The packaging material according to claim 1, in which a thermally insulating flexible sheet is placed on a surface of the oriented film made of a synthetic resin and affixed thereto partially or over the entire surface.

3. A packaging material comprising a cover using the packaging material according to claim 1 and provided with an excess portion and a container having an opening on which the cover is heat-sealed, the cover having a larger area than the area of the opening of the container and the excess portion of the cover dangles from an upper end of the container and is adhesively bonded to the container at an end portion thereof.

4. A packaged product in which processed food, various food products, various foodstuffs, medical instruments, or containers are tightly sealed with the packaging material according to claim 1.

* * * * *